US010847900B2

(12) United States Patent
Heo et al.

(10) Patent No.: US 10,847,900 B2
(45) Date of Patent: Nov. 24, 2020

(54) ANTENNA ARRAY AND RADAR DEVICE USING THEREOF

(71) Applicant: Mando Corporation, Pyeongtaek-si (KR)

(72) Inventors: Sung Joon Heo, Seongnam-si (KR); Su Han Kim, Yongin-si (KR)

(73) Assignee: MANDO CORPORATION, Pyeongtaek-si (KR)

( * ) Notice: Subject to any disclaimer, the term of this patent is extended or adjusted under 35 U.S.C. 154(b) by 0 days.

(21) Appl. No.: 16/420,722

(22) Filed: May 23, 2019

(65) Prior Publication Data

US 2019/0379140 A1 Dec. 12, 2019

(30) Foreign Application Priority Data

Jun. 8, 2018 (KR) ..... 10-2018-0065787

(51) Int. Cl.
*H01Q 21/00* (2006.01)
*H01Q 21/28* (2006.01)

(52) U.S. Cl.
CPC ..... *H01Q 21/28* (2013.01); *H01Q 21/0006* (2013.01)

(58) Field of Classification Search
None
See application file for complete search history.

(56) References Cited

U.S. PATENT DOCUMENTS

2009/0146904 A1 6/2009 Shi et al.
2012/0139661 A1* 6/2012 Itoh ..... H01P 5/222 333/118

(Continued)

FOREIGN PATENT DOCUMENTS

CN 107113017 A 8/2017
CN 206461086 U 9/2017
CN 107526063 A 12/2017

OTHER PUBLICATIONS

Office Action issued in Chinese Patent Application No. 201910450434.4, dated Sep. 2, 2020.

*Primary Examiner* — Anh Q Tran
(74) *Attorney, Agent, or Firm* — Morgan, Lewis & Bockius LLP

(57) ABSTRACT

The present disclosure provides the antenna array and the radar device including at least one first antenna arranged in one direction; at least one second antenna spaced apart from the first antenna; at least one shared antenna arranged between the first antenna and the second antenna; a first input-output terminal connected to the first antenna; a second input-output terminal connected to the second antenna; and a connector including a first port connected to the first antenna, a second port connected to the second antenna, a third port connected to the shared antenna, and a connecting portion connected to the first port, the second port and the third port; wherein a signal input to one of the first port and the second port is transmitted to the other port through a first path and a second path, and wherein the signal passed through the first path and the second path are matched at the other port. According to the present disclosure, it is possible to provide the antenna array and the radar device that can be efficiently disposed in a limited space to maximize spatial advantage.

14 Claims, 7 Drawing Sheets

<TX>

<RX>

(56) References Cited

U.S. PATENT DOCUMENTS

2014/0203960 A1* 7/2014 Huang ..... H01P 5/12
342/175
2014/0347248 A1* 11/2014 Stjernman ..... H01Q 21/24
343/893

* cited by examiner

FIG.6

| Output / Input | First Port (P1) | Third Port (P3) | Second Port (P2) |
|---|---|---|---|
| First Port (P1) | – | o | Matching (Cancel) |
| Third Port (P3) | o | – | o |
| Second Port (P2) | Matching (Cancel) | o | – |

ANTENNA ARRAY AND RADAR DEVICE USING THEREOF

CROSS REFERENCE TO RELATED APPLICATION

This application claims priority from Korean Patent Application No. 10-2018-0065787, filed on Jun. 8, 2018, which is hereby incorporated by reference for all purposes as if fully set forth herein.

BACKGROUND OF THE INVENTION

1. Field of the Invention

The present disclosure relates to an antenna array and radar device using the antenna array.

2. Description of the Prior Art

A radar device is an apparatus for detecting the distance to the target, the direction of the target, and information about the target by transmitting electromagnetic waves to the target at a remote location, receiving and analyzing reflection waves reflected from the target.

The application range of the radar device is very wide. For example, autonomous driving vehicles may include the radar device or radar sensor to perform advanced driver assistance system (ADAS), autonomous emergency braking (AEB) systems and so on.

Recently, the radar device has been downsized in accordance with the miniaturization of vehicles. In order for the miniaturized radar device to accurately detect the target, the number of antennas included in the miniaturized radar device should be increased.

However, it is difficult to continuously increase the number of antennas due to the space limitation of the radar device. Therefore, there is a need for a scheme for efficiently arranging antennas in a limited space of the radar device.

SUMMARY OF THE INVENTION

For this background, an object of the present disclosure is to provide an antenna array which are efficiently arranged in a limited space to maximize spatial advantage and a radar device having the antenna array.

Another object of the present disclosure to provide an antenna array and a radar device that can reduce manufacturing costs by using a shared antenna.

In accordance with an aspect of the present disclosure, there is provided an antenna array including: at least one first antenna arranged in one direction; at least one second antenna spaced apart from the first antenna; at least one shared antenna arranged between the first antenna and the second antenna; a first input-output terminal connected to the first antenna; a second input-output terminal connected to the second antenna; and a connector including a first port connected to the first antenna, a second port connected to the second antenna, a third port connected to the shared antenna, and a connecting portion connected to the first port, the second port and the third port; wherein a signal input to one of the first port and the second port is transmitted to the other port through a first path and a second path, and wherein the signal passed through the first path and the second path are matched at the other port.

In accordance with another aspect of the present disclosure, there is provided a radar device including: a transmitter for generating a transmission signal; a receiver for processing the receiving signal received through the antenna; an antenna module for radiating the transmission signal or receiving the receiving signal; and a switching module for selecting one of the transmitter and the receiver and switching the connection to be connected to the antenna module, wherein the antenna module includes: at least one first antenna arranged in one direction; at least one second antenna spaced apart from the first antenna; at least one shared antenna arranged between the first antenna and the second antenna; a first input-output terminal connected to the first antenna; a second input-output terminal connected to the second antenna; and a connector including a first port connected to the first antenna, a second port connected to the second antenna, a third port connected to the shared antenna, and a connecting portion connected to the first port, the second port and the third port; wherein a signal input to one of the first port and the second port is transmitted to the other port through a first path and a second path, and wherein the signal passed through the first path and the second path are matched at the other port.

According to the present disclosure, it is possible to provide an antenna array and a radar device that can be efficiently disposed in a limited space to maximize spatial advantage.

Furthermore, according to the present disclosure, it is possible to provide an antenna array and a radar device that can reduce manufacturing cost by using a shared antenna.

In addition, according to the present disclosure, space utilization and manufacturing easiness can be improved by mounting the antenna and the connector on the same plane.

BRIEF DESCRIPTION OF THE DRAWINGS

FIG. 6 is a table representing signals transmitted from the input port to the output port.

DETAILED DESCRIPTION OF THE EXEMPLARY EMBODIMENTS

Figure 1:
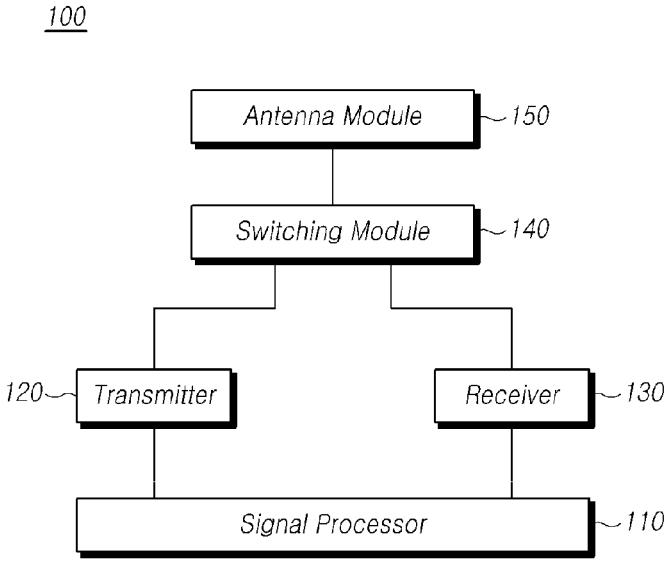
FIG. 1 is a diagram schematically illustrating the configuration of a radar device according to the present disclosure.

Hereinafter, embodiments of the present disclosure will be described with reference to exemplary diagrams. In the specification, in adding reference numerals to components throughout the drawings, it should be noted that like reference numerals designate like components even though components are shown in different drawings. Further, in describing embodiments of the present disclosure, well-known functions or constructions will not be described in detail since they may unnecessarily obscure the understanding of the present disclosure.

Further, terms such as 'first', 'second', 'A', 'B', '(a)', and '(b)' may be used for describing components of the present disclosure. These terms are used only for discriminating the components from other components, so the essence or order of the components indicated by those terms is not limited. It should be understood that when one element is referred to as being "connected to", "combined with" or "coupled to" another element, it may be connected directly to or coupled directly to another element, or another element may be "connected", "combined", or "coupled" between them.

FIG. 1 is a diagram schematically illustrating the configuration of the radar device 100 according to the present disclosure.

Referring to FIG. 1, the radar device 100 according to the present disclosure may include the transmitter 120 for generating the transmission signal, the receiver 130 for processing the receiving signal received through the antenna, the antenna module 150 for radiating the transmission signal or receiving the receiving signal, the switching module 140 for selecting one of the transmitter 120 and the receiver 130 to be connected to the antenna module 150, and the signal processor 110.

In the present disclosure, the antenna module 150 may also be referred to "antenna" and the switching module 160 may also be referred to as "switcher".

The signal processor 110 may generate an identification code and transmit the identification code to the transmitter 120 and the receiver 130.

Here, the identification code is an identifier for distinguishing the transmission signal or the receiving signal radiated from each of the plurality of radar devices.

The identification code may be composed of the data string including a length of a predetermined number of bits.

The signal processor 110 may generate the identification code in the case of the operation of the radar device 100. Alternatively, the signal processor 110 may transmit the identification code which is preset and stored to the transmitter 120 and the receiver 130.

In the case that the signal processor 110 generates the identification code, the signal processor 110 may randomly generate the identification code using a pseudo random function.

The signal processor 110 may analyze the target data transmitted from the receiver 130 to obtain target information.

Here, the target information may include information on the presence or absence of the target, the distance information of the target and velocity information of the target.

Meanwhile, the signal processor 110 may control the transmitter 120 to generate a signal. Here, the signal may be a signal fed by the signal processor 110. At this case, the signal processor 110 may set the frequency and the waveform of the signal.

The signal processor 110 may be implemented as the integrated control device or as the module of an electronic control unit (ECU) installed in the vehicle.

The integrated control device or ECU of the vehicle may include a processor, a storage device such as a memory and a computer program capable of performing a specific function. The signal processor 110 may be implemented as a software module capable of performing the functions described above.

The transmitter 120 may generates the signal and outputs the transmission signal which is phase-adjusted to the antenna module 150 by adjusting the phase of the signal in response to the identification code generated in the signal processor 110.

The transmitter 120 may include an oscillator, a voltage control oscillator (VCO) and the like, and the transmitter 120 may generate the signal having a specific waveform according to the control of the signal processor 110.

The receiver 130 may preprocess the receiving signal received through the antenna module 150 and may filter the receiving signal according to the identification code so that extract the receiving signal which is a reflection signal of the transmission signal reflected from the target.

The receiver 130 may receive the receiving signal from the antenna module 150 and may sample the receiving signal to obtain the receiving data.

Accordingly, the receiver 130 may include a low noise amplifier (LNA) for low noise amplification, a mixer for mixing the low noise amplified receiving signal, an amplifier for amplifying the mixed receiving signal, sampler and a digital filter for digitally converting the amplified receiving signal and for generating the receiving data.

The receiver 130 may generate a code window corresponding to the identification code, may compare the code window with the receiving data, and may extract the target data for the receiving signal.

Here, the target data may be data having a pattern similar to that of the transmission signal radiated according to the identification code in receiving data. The target data may be data on a reflection signal component in which a transmission signal is reflected on the target among the receiving signal.

The switching module 140 may electrically connect one of the transmitter 120 and the receiver 130 to the antenna module 150.

For example, the switching module 140 may be electrically connected to the transmitter 120 so that the transmission signal is transmitted to the antenna module 150. In this case, the switching module 140 may be electrically isolated from the receiver 130.

In another example, the switching module 140 may be electrically connected to the receiver 130 in order for the receiver 130 to receive the receiving signal from the antenna module 150. In this case, the switching module 140 may be electrically isolated from the transmitter 120.

The antenna module 150 may receive the transmission signal from the transmitter 120, may radiate the transmission signal, and may receive the receiving signal and transmit the receiving signal to the receiver 130.

The antenna module 150 may include antennas disposed at different positions and the connectors connected to each other through feed lines included in the antennas.

Each of the antennas disposed at different positions may be implemented by an antenna array in which a plurality of feed elements or a plurality of radiation elements are arranged.

By using such the antenna array, the antenna module 150 can vary the strength and direction of the transmission signal and radiate the transmission signal. That is, the antenna module 150 can adjust the beam pattern of the transmission signal.

The specific structure of the antenna module 150 will be described in detail with reference to FIG. 2.

Figure 2:
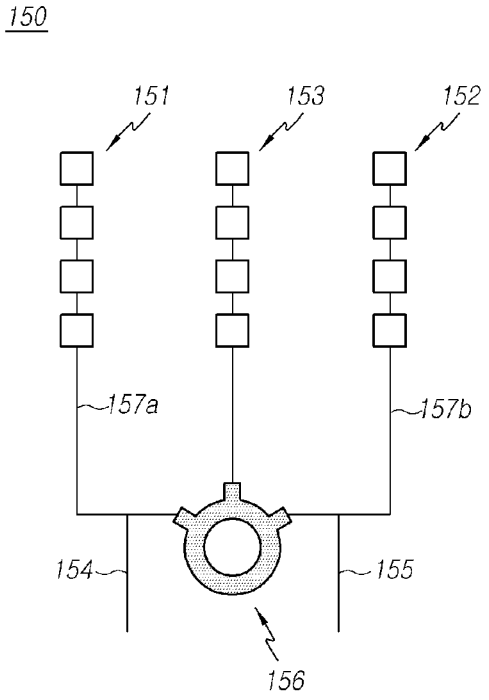
FIG. 2 is a diagram schematically illustrating the structure of an antenna module included in the radar device according to the present disclosure.
Figure 3:
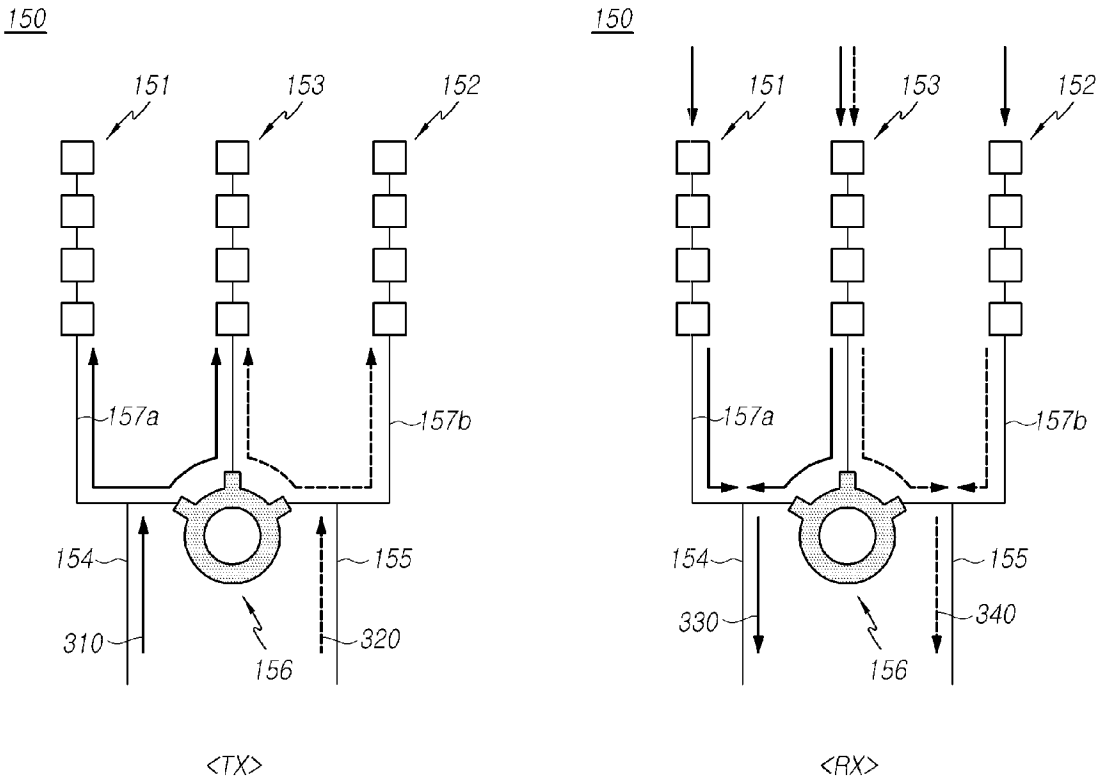
FIG. 3 is a diagram schematically illustrating a flow of a transmission signal and a receiving signal in the antenna module included in the radar device according to the present disclosure.

FIG. 2 is a diagram schematically illustrating the structure of the antenna module 150 included in the radar device 100 according to the present disclosure, and FIG. 3 is a diagram schematically illustrating a flow of the transmission signal and the receiving signal in the antenna module 150 included in the radar device 100 according to the present disclosure.

Referring to FIG. 2, the antenna module 150 may include at least one first antenna 151 arranged in one direction, at least one second antenna 152 arranged apart from the first antenna 151, the first input-output terminal 154 connected to the first antenna 151, the second input-output terminal 155 connected to the second antenna 152, and the connector 156 for connecting the antennas 151, 152 and 153.

The first antenna 151 may include at least one radiator or radiation element in the form of a microstrip patch whose size and spacing are determined based on various types of array functions such as uniform, binomial, Taylor and Chebyshev.

The first antenna 151 may be arranged in a specific direction at a specific location. For example, the first antenna may be located on the left side with respect to the shared antenna 153, and arranged in the upward direction.

The number of the first antennas 151 may be one or more. In the cast that the number of the first antennas 151 is two or more, the first antennas 151 may be arranged in parallel with each other.

For example, the two first antennas 151 may be located on the left side with respect to the shared antenna 153, and may be arranged in the upward direction, and each of the first antennas 151 may be arranged in parallel with each other at a constant distance.

The second antenna 152 may include at least one radiator or radiation element in the form of a microstrip patch whose size and spacing are determined based on various types of array functions such as uniform, binomial, Taylor and Chebyshev.

The second antenna 152 may be arranged in a specific direction at a specific location. For example, the second antenna 152 may be located on the right side with respect to the shared antenna 153, and arranged in the upward direction.

The number of the second antennas 152 and the arrangement of the plurality of second antennas 152 may be similar to those of the first antenna 151.

For example, the two second antennas 152 may be located on the right side with respect to the shared antenna 153, and may be arranged in the upward direction, and each of the second antennas 152 may be arranged in parallel with each other at a constant distance.

Here, one or more first antennas 151 and one or more second antennas 152 may be symmetrically arranged with respect to one or more shared antennas 153.

The shared antenna 153 includes a radiator in the form of a microstrip patch. The shared antenna 153 may emit the transmission signal and receive the receiving signal with the first antenna 151, and may emit the transmission signal and receive the receiving signal with the second antenna 152.

In the cast that the number of each of the first antenna 151 and the number of the second antennas 152 is N (N is a natural number equal to or greater than 1), the shared antenna 153 constitutes an N+1 antenna array structure together with the first antenna 151 and simultaneously constitutes an N+1 antenna array structure together with the second antenna 152.

For example, in the case that the first antenna 151 and the second antenna 152 are each formed as a single antenna, the shared antenna 153 and the first antenna 151 form a two-antenna array structure, and the shared antenna 153 and the second antenna 152 form a two-antenna array structure simultaneously.

Similarly, in the case that the first antenna 151 and the second antenna 152 are each formed as two antennas, the shared antenna 153 and the first antenna 151 form a three-antenna array structure, and the shared antenna 153 and the second antenna 152 form a three-antenna array structure simultaneously.

The shared antenna 153 may be arranged in the same direction as the first antenna 151 and the second antenna 152 between the first antenna 151 and the second antenna 152. For example, the shared antenna may be arranged in an upward direction between the first antenna 151 arranged on the left side and the second antenna 152 arranged on the right side.

The number of the shared antennas 153 may be one or more. In the case that the number of the shared antennas 153 is two or more, the shared antennas 153 may be arranged in parallel with each other.

Here, In the case that the number of the shared antennas 153 is two or more, the two or more shared antennas 153 and the first antenna 151 or the second antenna 152 may form a structure of more than three antenna arrays structure.

For example, if there are two shared antennas 153, and each of the first antenna 151 and the second antenna 152 is one, the two shared antennas 153 and the first antenna 151 may form the three-antenna array structure. Similarly, the two shared antennas 153 and the second antenna 152 may form a three-antenna array structure.

Each of the first antenna 151, the second antenna 152, and the shared antenna 153 may be leaky antennas which are an integrated antenna for transmitting and receiving, and may be microstrip antennas. However, the present disclosure is not limited thereto.

Radiation conductance of the antennas 151, 152, and 153 may be adjusted according to various required performances such as gain and sidelobe level characteristics.

The first input-output terminal 154 may be arranged in which one end of the first input-output terminal 154 may be electrically connected to the first feed line 157*a* included in the first antenna 151 and the other end of the first input-output terminal 154 may be electrically connected to the switching module 140.

The second input-output terminal 155 may be arranged in which one end of the second input-output terminal 155 may be electrically connected to the second feed line 157*b* included in the second antenna 152, and the other end of the second input-output terminal 155 may be electrically connected to the switching module 140.

Although the first input-output terminal 154 and the second input-output terminal 155 are described as separate structures, the first input-output terminal 154 and the second input-output terminal 155 may be integral type connected to each other.

The feed line 157 may be a medium for transmitting the transmission signal or a receiving signal.

In one example, a portion of the transmission signal is immediately provided to the first antenna 151 or the second antenna 152 to be radiated, while the remaining portion of the transmission signal may travel continuously through the feed line 157 to the connector 156.

Alternatively, the receiving signal may be received through the first antenna 151 and the second antenna 152 and then directly transmitted to the input-output terminals 154 and 155 respectively electrically connected to the first antenna 151 and the second antenna 152. The receiving signal received through the shared antenna 153 may travel to the connector and may be transmitted to the input-output terminals 154 and 155.

The connector 156 is electrically connected to the first antenna 151, the second antenna 152 and the shared antenna 153.

The connector 156 may be mounted on the same plane as the first antenna 151, the second antenna 152 and the shared antenna 153.

For example, the connector 156 may be configured in the same plane as the first antenna 151, the second antenna 152, and the shared antenna 153 when mounted on a PCB substrate. This can reduce the cost and manufacturing difficulty required for the design and manufacture of multi-layered PCB boards. In addition, the increased area consumption can be minimized by utilizing the shared antenna 153 by being formed on the same plane.

The antenna array according to the present disclosure has the effect of securing a spatial advantage by providing the shared antenna 153. In addition, it is possible to reduce a manufacturing difficulty and a manufacturing cost for the antenna device.

The connector 156 may adjust the phase of the transmission signal or receiving signal transmitted through the connector 156.

The connector 156 may perform a power distribution function for feeding to the antennas 151, 152 and 153. The connector 156 also may serve as a power combiner that combines the receiving signals (RF power, etc.) received at the antennas 151, 152 and 153.

The connector 156 may be configured such that the transmission signal transmitted to the first input-output terminal 154 and the second input-output terminal 155 is transmitted to the shared antenna 153 or the receiving signal received from the shared antenna 154 is distributed and transmitted to the first input-output terminal 154 and the second input-output terminal 155.

At this case, the transmission signal transmitted to the first input-output terminal 154 may be radiated through the first antenna 151 and the shared antenna 153, but may be not radiated to the second antenna 152.

Similarly, the transmission signal transmitted to the second input-output terminal 155 may be radiated through the second antenna 152 and the shared antenna 153, but may be not radiated to the first antenna 151.

Although not shown, the antenna module 150 may include a dielectric substrate on which the antennas 151, 152 and 153, input-output terminals 154 and 155, a connector 156 and the like are printed, and a ground plane formed at the lower end of the dielectric substrate. The antenna array structure printed on top of the dielectric substrate may be arranged in a single layer.

Since the antenna module 150 may be printed on the dielectric substrate and may be fabricated in a 2D form (planar form), it is advantageous in mass production due to easy design and manufacturing process.

Hereinafter, the process of transferring a transmission signal and a receiving signal to the antennas will be described in detail with reference to FIG. 3.

Referring to the transmission operation <TX> in FIG. 3, the first transmission signal 310 transmitted to the first input-output terminal 154 is transmitted to the first antenna 151 arranged on the left side through the first feed line 157*a*.

Meanwhile, the first transmission signal 310 transmitted to the fir.st input-output terminal 154 is transmitted to the connector 156. The first transmission signal 310 transmitted to the connector 156 can be transmitted to another antenna while the phase of the transmission signal is adjusted through the connector.

At this time, the first transmission signal 310 is transmitted to the shared antenna 153, but is not to transmitted to the second antenna 152.

Similarly, the second transmission signal 320 transmitted to the second input-output terminal 155 is transmitted to the second antenna 152 arranged on the right side through the second feed line 157*b*.

Meanwhile, the second transmission signal 320 transmitted to the second input-output terminal 155 is transmitted to the connector 156. The second transmission signal 320 transmitted to the connector 156 may be transmitted to another antenna while the phase of the transmission signal is adjusted through the connector.

At this time, the second transmission signal 320 is transmitted to the shared antenna 153, but is not transmitted to the first antenna 151.

Referring to the transmission operation <RX> in FIG. 3, the first receiving signal 330 received through the first antenna 151 is transmitted to the first input-output terminal 154 through the first feed line 157*a*.

The second receiving signal 340 received through the second antenna 152 is transmitted to the second input-output terminal 155 through the second feed line 157*b*.

The first receiving signal 330 and the second receiving signal 340 received through the shared antenna 153 are transmitted to the connector 156. The first receiving signal 330 and the second receiving signal 340 transmitted to the connector 156 are transmitted to the first feed line 157*a* and the second feed line 157*b*, respectively.

The first receiving signal 330 transmitted through the shared antenna 153 and the connector 156 is transmitted to the first input-output terminal 154.

Similarly, the second receiving signal 340 transmitted through the shared antenna 153 and the connector 156 is transmitted to the second input-output terminal 155.

As described above, the first antenna 151 and the shared antenna 153 may operate as the antenna having a two-antenna array structure in which the first transmission signal 310 is radiated or the first receiving signal 330 is received.

Similarly, the second antenna 152 and the shared antenna 153 may operate as the antenna having a two-antenna array structure in which the second transmission signal 320 is transmitted or the second receiving signal 340 is received.

The specific structure of the connector 156 and the principle that the signal (including the transmission signal and the receiving signal) transmitted through the antenna of either the first antenna 151 or the second antenna 152 is not transmitted to the remaining antennas will be described with reference to FIG. 4.

Figure 4:
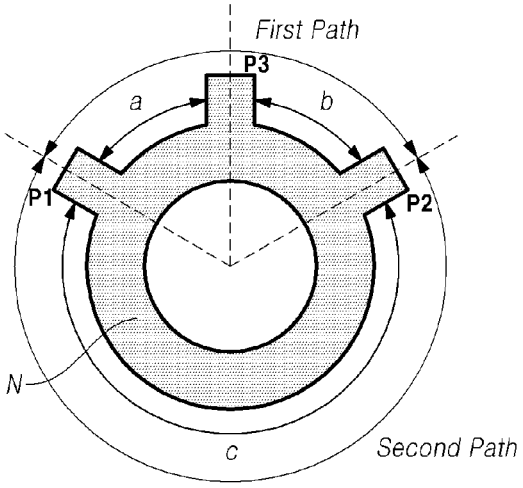
FIG. 4 is a schematic view of the connector included in the radar device according to the present disclosure.

FIG. 4 is a schematic view of the connector 156 included in the radar device 100 according to the present disclosure.

Referring to FIG. 4, the connector 156 may include the first port P1 connected to the first antenna 151, the second port P2 connected to the second antenna 152, the third port P3 connected to the shared antenna 153, and the connecting portion N connected to the first port P1, the second port P2 and the third port P3.

The connecting portion N may be a conductor connecting between the ports. In FIG. 4, the connecting portion N is formed in a ring shape, but is not limited thereto. It should be noted, however, that FIG. 4 illustrates a ring shape for convenience of explanation.

The connector 156 may include three ports P1 to P3 arranged radially sequentially from the ring-shaped center portion of the connecting portion N.

The three ports P1 to P3 may be spaced apart from each other by a specific distance along the central portion of the ring shape.

Signal inputted to each of three ports may be transmitted to other ports, and signal transmitted to the other ports may be changed in phase.

In this specification, the signal may be the transmission signal or the receiving signal. Hereinafter, for convenience of explanation, the signal means the transmission signal or the receiving signal.

The connector 156 is formed in which the signal input to one port of the first port P1 and the second port P2 is transmitted to the other port through the first path and the second path, and the signals transmitted through the first path and the second path are match at the other port.

Here, the matching means that the phase of a signal transmitted to a specific port through one path and the phase of a signal transmitted to the specific port through the other path different from one path are opposite in phase.

That is, the signals transmitted to the specific port through different paths have a phase difference of 180 degrees, which means that the signals may cancel each other.

The third port P3 is connected to the first path, and the length between the first port P1 and the third port P3 in the first path may be equal to the length between the second port P2 and the third port P3.

For example, the interval "a" between the first port P1 and the third port P3, and the interval "b" between the second port P2 and the third port P3 is ¼ (λ/4) of the wavelength of the signal respectively. The interval "c" between the first port P1 and the second ports P2 may be the wavelength (λ) of the signal.

The first path may be defined as one of paths from the first port P1 to the second port P2. For example, in FIG. 4, the path from the first port P1 to the second port P2 may be a path including the third port P3.

The second path may be defined as the remaining path from the first port P1 to the second port P2 except for the first path. For example, the second path may be a path not including the third port P3 from the first port P1 to the second port P2.

Here, the difference between the length of the first path and the length of the second path may be one-half (λ/2) of the wavelength of the signal.

In the case that the difference between the length of the first path and the length of the second path may be one-half (λ/2) of the wavelength of the signal, if signals input to one port of the first port P1 and the second port P2 are transmitted to the other port through the first path and the second path, the two signals transmitted through the first path and the second path may be matched or cancelled at the other port.

As described above, the first transmission signal 310 transmitted to the first input-output terminal 154 is not radiated by the second antenna 152 and the second transmission signal 320 transmitted to the second input-output terminal 155 is not radiated by the first antenna 151.

Hereinafter, there will be described the process of transmitting the signal input to the first port P1 or the second port P2 to the third port P3.

The third port P3 is connected to the first path, and the signal input to one of the first port P1 and the second port P2 is transmitted to the third port P3 through the path between the one port to which the signal is input and the third port P3 among the first path, and is transmitted to the third port P3 through the second path and the path between the other port (i.e. a port to which the signal is not input among the first port P1 and the second port P2) and the third port P3 among the first path.

For example, the signal input to the first port P1 is transmitted to the third port P3 through the path corresponding to the interval "a" in the first path, and is also transmitted to third port P3 through the second path and the path corresponding to the interval "b" between the second port P2 and the third port P3 in the first path.

In this case, the phase of the signal transmitted through the path between one port to which the signal is inputted and the third port P3 in the first path may be the same as the phase of the signal transmitted through the second path and the path between the other port and the third port P3 in the first path.

According to the example as above, the interval "a" between the first port P1 and the third port P3 and the interval "b" between the second port P2 and the third port P3 may be ¼ (λ/4) of the wavelength of the signal. In the cast that the interval "c" (i.e. the length of the second path) between the first port P1 and the second port P2 is the wavelength λ of the signal, if the signal input to the first port P1 is transmitted to the third port P3, the phase changes by 90 degrees and is the same regardless of the path.

Hereinafter, there will be described the process in which the signal input to the third port P3 is transmitted to the first port P1 and the second port P2.

The third port P3 is connected to the first path, the signal input to the third port P3 may be transmitted to one of the first port P1 and the second port P2 through a portion of the first path, and may be transmitted to the one port through the remaining path of the first path and the second path.

As another example, the signal input to the third port P3 is transmitted to the first port P1 through the path corresponding to the interval "a" in the first path, and is also transmitted to the first port P1 through the path corresponding to the interval "b" between the second port P2 and the third port P3 in the first path and the second path.

The phase of the signal transmitted through the portion of the first path may be the same as the phase of the signal transmitted through the remaining portion of the first path and the second path.

In another example described above, the interval "a" between the first port P1 and the third port P3 and the interval "b" between the second port P2 and the third port P3 are ¼ (λ/4) of the wavelength of the signal respectively. The interval "c" (i.e. the length of the second path) between the first port P1 and the second port P2 is the wavelength λ of the signal. Therefore, if the signal input to the third port P3 is transmitted to the first port P1, the phase changes by 90 degrees and is the same regardless of the path.

The connector 156 may be implemented as a Rat-Race coupler or a ring hybrid coupler, but is not limited thereto.

In addition, although not shown, there may be further provided the fourth port P4 which is connected to the termination means such as terminating resistance in order to isolate the noise signal. Here, the terminating resistance may be generally 50 ohms, but is not limited thereto.

Figure 5:
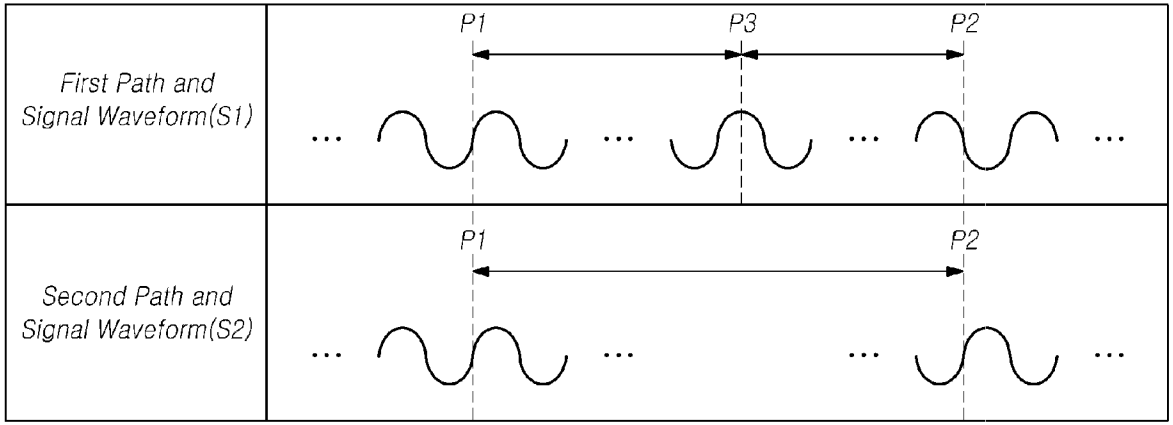
FIG. 5 is a diagram illustrating the waveform of the signal transmitted through the first path and the waveform of the signal transmitted through the second path.

FIG. 5 is a diagram illustrating the waveform of the signal transmitted through the first path and the waveform of the signal transmitted through the second path.

FIG. 6 is a table representing signals transmitted from the input port to the output port.

Referring to FIG. 5, in the case that signal transmitted to one of the first port P1 and the second port P2 are transmitted to the other port, the phase of the signal transmitted to the other ports through the first path may be in opposite phase or antiphase to the phase of the signal transmitted to the other ports through the second path.

There will be described an example in which the interval "a" between the first port P1 and the third port P3 and the interval "b" between the second port P2 and the third port P3 are ¼ (λ/4) of the wavelength of the signal respectively, and the interval "c" between the first port P1 and the second port P2 is the wavelength (λ) of the signal.

If the signal input to the first port P1 is transmitted to the third port P3 through the first path, the phase of the transmitted signal may be adjusted to have a 90 degree difference. If the signal is subsequently transmitted to the second port P2, the phase of the transmitted signal may be adjusted to have 180 degrees difference. On the other hand, if the signal inputted to the first port P1 is transmitted to the second port P2 through the second path, the phase of the transmitted signal may change 360 degrees and may be in phase with the signal input to the first port P1.

Accordingly, the phase difference between the two signals transmitted to the second port P2 and adjusted in phase may be 180 degrees, which is the antiphase or opposite-phase relationship. Thus, the two signals may be matched (canceled).

Although there is described the case of FIG. 5 in which the signal inputted to the first port P1 is matched if the signal is transmitted to the second port P2, the signal inputted to the second port P2 may also be matched or cancelled if the signal is transmitted to the first port P1.

The table of FIG. 6 summarizes various cases in which signals input to the specific port are transmitted to other ports and output as described above.

Here, the indication "o" indicates that the signal input to the corresponding port can be output to another port.

Figure 7:
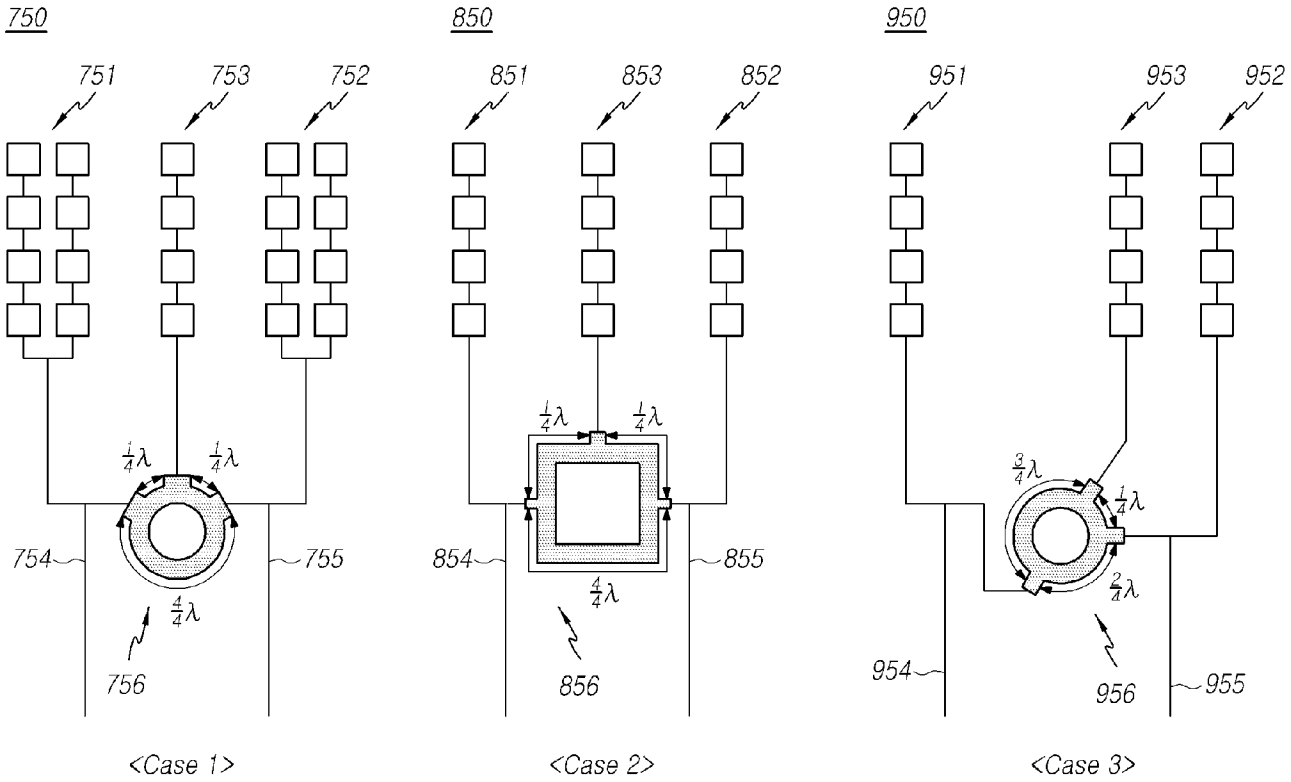
FIG. 7 is a diagram illustrating embodiments of the antenna module included in the radar device according to the present disclosure.

FIG. 7 is a diagram illustrating embodiments of the antenna module 750, 850, 950 included in the radar device according to the present disclosure.

Referring to FIG. 7, the antenna module included in the radar device 100 according to the present disclosure may have various embodiments by varying the number of antennas or by adjusting the shape of the connecting portion N included in the connector or the distance between the ports.

According to the case 1 of FIG. 7, the antenna module 750 may include two first antennas 751, two second antennas 752, one shared antenna 753, and a connector 756.

The two first antennas 751 are arranged on the left side of the shared antenna 753. The first input-output terminal 754 is electrically connected to the two first antennas 751.

The two second antennas 752 are arranged on the right side of the shared antenna 752. The second input-output terminal 755 is electrically connected to the two second antennas 752.

The two first antennas 751, the two second antenna 752, the shared antenna 753 and the connector 756 may be mounted on the same plane.

The first antenna 751 and the second antenna 752 may have the symmetric structure with respect to the shared antenna 753.

The connector 756 may include the ring-shaped connecting portion N and three ports. Here, the interval between the first port P1 and the second port P2 corresponds to the wavelength λ of the signal, and the interval between the second port P2 and the third port P3 corresponds to ¼ (λ/4) of the wavelength of the signal. The interval between the first port P1 and the third port P3 is ¼ (λ/4) of the wavelength of the signal.

Thus, the two first antennas 751 and the shared antenna 753 constitute the three-antenna array structure, and the two second antennas 752 and the shared antenna 753 constitute the three antenna array structures.

In case 2 of FIG. 7, the antenna module 850 has a structure similar to the antenna module 150 shown in FIG. 2 described above.

However, in the antenna module 850 of the case 2 of FIG. 7, the intervals between the ports is correspondent with the case 1 of FIG. 7, and the connector 856 includes the connecting portion N in the form of a square ring.

In case 3 of FIG. 7, the intervals between the ports of the antenna module 950 are modified. That is, the interval between the first port P1 and the second port P2 is ¾ (2λ/4) of the wavelength of the signal, and the interval between the second port P2 and the third port P3 is ¼ (λ/4) of the wavelength of the signal, and the interval between the first port P1 and the third port P3 is ¾ (3λ/4) of the wavelength of the signal.

In this case, the signal (generally, the receiving signal) inputted to the third port P3 is distributed to the first port P1 and the second port P2. Since the signal output to the first port P1 has a phase difference of 270 degrees and the signal output to the second port P2 has a phase difference of 90 degrees, the phase difference between the two signals may be 180 degrees. However, since the two signals are signals output to different ports, two signals are not matched.

With the same principle, if the signal input to the first port P1 (generally, the transmission signal) is output to the third port P3, the signal has a phase difference of 270 degrees. In addition, if the signal input to the second port P2 is output to the third port P3, the signal has a phase difference of 90 degrees. Therefore, the phase difference between the two signals is 180 degrees.

As described above, according to the present disclosure, it is possible to provide the antenna array and the radar device that can be efficiently disposed in a limited space to maximize spatial advantage.

Furthermore, according to the present disclosure, it is possible to provide an antenna array and a radar device that can reduce manufacturing cost by using a shared antenna.

Even though all components of embodiments of the present disclosure were described as being combined in a single part or being operated in cooperation with each other, the present disclosure is not limited thereto. That is, all the components may be selectively combined one or more parts and operated if it is within the object of the present disclosure. Further, all of the components may be implemented by single independent hardware, respectively, but some or all of the components may be selectively combined and implemented by computer programs having a program module that performs some or all of functions combined by one or more pieces of hardware. Codes or code segments constituting the computer programs may be easily inferred by those skilled in the art. The computer programs are stored in computer-readable media and read and executed by a computer, whereby embodiments of the present disclosure can be achieved. A magnetic storing medium, an optical recording medium, and a carrier wave medium may be included in the recording media of computer programs.

Further, terms 'include', 'constitute', 'have' etc. stated herein means that corresponding components may be included, unless specifically stated, so they should be construed as being able to further include other components rather than excepting other components. Unless defined otherwise, all the terms used in the specification including technical and scientific terms have the same meaning as those that are understood by those skilled in the art. The terms generally used such as those defined in dictionaries should be construed as being the dame as the meanings in the context of the related art and should not be construed as being ideal or excessively formal meanings, unless defined in the present disclosure.

The above description is an example that explains the spirit of the present disclosure and may be changed and modified in various ways without departing from the basic features of the present disclosure by those skilled in the art. Accordingly, the embodiment described herein are provided not to limit, but to explain the spirit of the present disclosure and the spirit and the scope of the present disclosure are not limited by the embodiments. The protective range of the present disclosure should be construed on the basis of claims and all the technical spirits in the equivalent range should be construed as being included in the scope of the right of the present disclosure.

What is claimed is:

1. An antenna array comprising:

at least one first antenna arranged in one direction;

at least one second antenna spaced apart from the first antenna;

at least one shared antenna arranged between the first antenna and the second antenna;

a first input-output terminal connected to the first antenna;

a second input-output terminal connected to the second antenna; and a connector including a first port connected to the first antenna, a second port connected to the second antenna, a third port connected to the shared antenna and a connecting portion connected to the first port, the second port and the third port;

wherein a signal input to one of the first port and the second port is transmitted to the other port through a first path and a second path, wherein the signal passed through the first path and the second path are matched at the other port.

2. The antenna array of claim 1, wherein a phase of the signal transmitted to the other port through the first path and a phase of the signal transmitted to the other port through the second path are in opposite phases.

3. The antenna array of claim 1, wherein the difference between the length of the first path and the length of the second path is one-half of a wavelength of the signal.

4. The antenna array of claim 1, wherein the third port is connected to the first path, and the length between the first port and the third port in the first path is equal to the length between the second port and the third port.

5. The antenna array of claim 1, wherein the third port is connected to the first port, wherein a signal input to one of the first port and the second port is transmitted to the third port through a path between the one port to which the signal is input and the third port among the first path, and is transmitted to the third port through the second path and a path between the other port and the third port among the first path, and wherein a phase of the signal transmitted through the path between the one port to which the signal is input and the third port is equal to a phase of a signal transmitted through the second path and a path between the other port and the third port among the first path.

6. The antenna array of claim 1, wherein the third port is connected to the first port, wherein a signal input to the third port is transmitted to one port of the first port and the second port through a part of the first path, and is transmitted to the one port through the rest of the first path and the second path, and wherein the phase of the signal transmitted through the part of the first path is the same as the phase of the signal transmitted through the rest of the first path and the second path.

7. The antenna array of claim 1, wherein the at least one first antenna and the at least one second antenna are symmetrically disposed with respect to the at least one shared antenna.

8. The antenna array of claim 1, wherein the first antenna, the second antenna, the shared antenna and the connector are mounted on the same plane.

9. A radar device comprising:

an antenna for radiating a transmission signal or receiving a receiving signal;

a transmitter for generating the transmission signal;

a receiver for processing the receiving signal received through the antenna; and a switcher for selecting one of the transmitter and the receiver and switching the connection to be connected to the antenna, wherein the antenna includes:

at least one first antenna arranged in one direction;

at least one second antenna spaced apart from the first antenna;

at least one shared antenna arranged between the first antenna and the second antenna;

a first input-output terminal connected to the first antenna;

a second input-output terminal connected to the second antenna; and a connector including a first port connected to the first antenna, a second port connected to the second antenna, a third port connected to the shared antenna and a connecting portion connected to the first port, the second port and the third port;

wherein a signal input to one of the first port and the second port is transmitted to the other port through a first path and a second path, wherein the signal passed through the first path and the second path are matched at the other port.

10. The radar device of claim 9, wherein a phase of the signal transmitted to the other port through the first path and a phase of the signal transmitted to the other port through the second path are in opposite phases.

11. The radar device of claim 9, wherein the difference between the length of the first path and the length of the second path is one-half of a wavelength of the signal.

12. The radar device of claim 9, wherein the third port is connected to the first path, and the length between the first port and the third port in the first path is equal to the length between the second port and the third port.

13. The radar device of claim 9, wherein the at least one first antenna and the at least one second antenna are symmetrically disposed with respect to the at least one shared antenna.

14. The radar device of claim 9, wherein the first antenna, the second antenna, the shared antenna and the connector are mounted on the same plane.

* * * * *